US006983552B2

(12) United States Patent
Park

(10) Patent No.: US 6,983,552 B2
(45) Date of Patent: Jan. 10, 2006

(54) LAUNDRY DRYER AND CONTROL METHOD THEREOF

(75) Inventor: Sang Ho Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/718,028

(22) Filed: Nov. 21, 2003

(65) Prior Publication Data

US 2004/0168344 A1 Sep. 2, 2004

(30) Foreign Application Priority Data

Nov. 26, 2002 (KR) ..... 10-2002-0073896

(51) Int. Cl.
*F26B 19/00* (2006.01)

(52) U.S. Cl. ..... 34/549; 34/550; 34/553; 219/497

(58) Field of Classification Search ..... 34/483, 34/486, 491, 528, 531, 425, 446, 474, 549, 34/562, 550, 553; 219/497
See application file for complete search history.

(56) References Cited

U.S. PATENT DOCUMENTS 4,481,786 A * 11/1984 Bashark ..... 62/160
4,827,627 A * 5/1989 Cardoso ..... 34/526
5,172,490 A * 12/1992 Tatsumi et al. ..... 34/488
5,315,765 A * 5/1994 Holst et al. ..... 34/260
5,570,520 A * 11/1996 Huffington ..... 34/535
6,079,121 A * 6/2000 Khadkikar et al. ..... 34/528
6,751,888 B2 * 6/2004 Lueckenbach ..... 34/595
6,845,290 B1 * 1/2005 Wunderlin et al. ..... 700/208

FOREIGN PATENT DOCUMENTS

EP 364080 A1 * 4/1990

* cited by examiner

*Primary Examiner*—Jiping Lu
(74) *Attorney, Agent, or Firm*—McKenna Long & Aldridge, LLP

(57) ABSTRACT

A laundry drier and control method thereof are provided, by which a new reference voltage is set to perform a next drying procedure if, upon a determination of a completion of a current drying procedure, there is a difference between a voltage representing a sensed level of water content (moisture) present in laundry and a sensed-moisture value at the end of the drying procedure, thereby compensating for the presence of contamination on and around the electrodes of a moisture sensor. The laundry drier includes a heater for performing a drying procedure; a moisture sensor for sensing a level of moisture in laundry during the drying procedure and outputting a voltage signal; a memory for storing a reference voltage value and a voltage value according to the sensed moisture level; and a microcomputer for controlling the heater based on the voltage signal output of the moisture sensor. The control method includes steps of driving a heater for a first predetermined time of a drying procedure; sensing a level of moisture in laundry after the first predetermined time has elapsed; storing in a memory a reference voltage value and a first value corresponding to the sensed moisture level; comparing the stored values, to determine a completion of the drying procedure; obtaining a second value corresponding to the sensed moisture level by driving the heater for a second predetermined time after the completion of the drying procedure; and compensating for an error in the sensed moisture level by resetting the reference voltage value according to a comparison of the first and second values.

15 Claims, 4 Drawing Sheets

LAUNDRY DRYER AND CONTROL METHOD THEREOF

This application claims the benefit of Korean Application No. 10-2002–0073896 filed on Nov. 26, 2002, which is hereby incorporated by reference.

BACKGROUND OF THE INVENTION

1. Field of the Invention

The present invention relates to a laundry drier, and more particularly, to a laundry drier and control method thereof in which a memory of a microcomputer is utilized so that a value comparison can be made between a predetermined reference voltage and a voltage representing a sensed level of moisture (water content or wetness) present in laundry upon completion of a drying procedure, to determine the presence of contamination and compensate for an error in sensing moisture accordingly.

2. Discussion of the Related Art

In general, a laundry drier is an apparatus for drying wet objects, e.g., clothes, after completion of a washing cycle or the like. FIG. 1 illustrates such a laundry drier.

Referring to FIG. 1, a drum 2 for holding laundry is installed rotatably inside a cabinet 1 having a front side in which an entrance 3 is provided. A door 4 is installed in the entrance 3 so that laundry may be placed in the drum 2 via the entrance. A motor 5, installed in an upper space of the cabinet 1, is coupled to the drum 2 via a drum belt 6*a* such that the drum rotates when the motor is driven. As the drum 2 rotates, the laundry is stirred by a plurality of lifts 7 installed on an inner surface of the drum. Meanwhile, the motor 5 is differentially coupled, via a fan belt 6*b*, to a fan 9 installed in a space provided behind the drum 2. By thus driving the fan 9, hot air, heated by a heater 11, is circulated through a series of ducts. A circulation duct 8 is provided such that the space provided for the fan 9 communicates with a point near the entrance 3, with an external air supply duct 12 for supplying external air, and with a drain duct 13 for discharging condensed water generated from the circulating hot air.

In the operation of a laundry drier constructed as above, with wet laundry placed in the drum 2, the laundry drier is actuated to drive the motor 5 and thereby rotate the drum, so that the laundry is pulled upward by the lifts 7 to fall back down and be gently mixed. Meanwhile, the driving force of the motor 5 is also transferred to the fan 9, thus circulating the air in the circulation duct 8. The circulating air is heated by the heater 11, and the heated air is supplied to the drum 2 to evaporate the water content of the laundry. Air circulation continues as external air is supplied to the circulation duct 8 through the external air supply duct 12, to be mixed with the heated air in the circulation duct. The water content in the circulating air is condensed to be discharged through the drain duct 13.

The drying of laundry using a laundry drier as described above is typically performed by a controlling apparatus such as that illustrated in FIG. 2.

Referring to FIG. 2, a laundry drier according to a related art is comprised of a moisture sensor 20, installed with respect to the interior of a rotatable drum as described above, for sensing the water content of laundry in the drum to determine the drying status of the laundry and outputting a value indicative of the water content; a voltage converter 30 for converting the water content value to a voltage and outputting a voltage signal; a microcomputer 40 for outputting a control signal to control a drying pattern based on the voltage signal output of the voltage converter; and a load driver 50 for respectively driving a motor 60 and a heater 70 according to the control signal output from the microcomputer.

More specifically, as the drum 2 rotates and the laundry comes into repeated contact with the moisture sensor 20, which is an electrode-type sensor, the water content in the laundry is sensed over the course of a drying procedure. The water content varies according to the drying status of the laundry, and the variation is represented by the voltage output from the voltage converter 30 and input to the microcomputer 40. The microcomputer 40 thus determines the laundry's drying status by reading the input voltage and thereby monitoring the water content as the laundry dries, to control the dry pattern accordingly. In doing so, the microcomputer 40 references the output voltage of the moisture sensor 20 and voltage converter 30 upon initiating a drying procedure and compares the referenced voltage with subsequent outputs over the course of the dry procedure.

After extended use of a laundry dryer as above, however, there is an accumulation of contaminants (e.g., corrosion and a buildup of foreign particles) that inherently forms on and around the electrodes of the moisture sensor 20, which results in a gradual increase of an error present in the sensed values. Moreover, the voltage output from the moisture sensor at the time of initiating a drying procedure differs from that at the completion of the drying procedure, where a contamination of the electrodes has occurred, which inhibits a precise sensing of the output voltage for later stages of the drying procedure. It should be appreciated that such contamination will usually result in an erroneous determination by the microcomputer that the laundry's water content remains after the laundry has been completely dried. In any event, an incorrect sensing of the water content of the laundry may result in an unnecessary continuation of the operation of the heater despite a completion of the drying procedure, to thereby cause overheating or a wasteful power consumption.

SUMMARY OF THE INVENTION

Accordingly, the present invention is directed to a laundry drier and control method thereof that substantially obviates one or more of the problems due to limitations and disadvantages of the related art.

An object of the present invention, which has been devised to solve the foregoing problem, lies in providing a laundry drier and control method thereof, by which a new reference voltage is set to perform a next drying procedure if, upon a determination of a completion of a current drying procedure, there is a difference between a voltage representing a sensed level of water content present in laundry and a sensed-moisture value at the end of the drying procedure, thereby compensating for the presence of contamination on and around the electrodes of a moisture sensor.

It is another object of the present invention to provide a laundry drier and control method thereof in which an optimum drying pattern is achieved.

It is another object of the present invention to provide a laundry drier and control method thereof that improves drying performance.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a laundry drier comprising a heater for performing a drying procedure; a moisture sensor for sensing a level of moisture in laundry during the drying procedure and outputting a voltage signal; a memory for storing a reference voltage value and a voltage value according to the sensed moisture level; and a microcomputer for controlling the heater based on the voltage signal output of the moisture sensor.

According to another aspect of the present invention, there is provided a laundry drier control method comprising steps of driving a heater for a first predetermined time of a drying procedure; sensing a level of moisture in laundry after the first predetermined time has elapsed; storing in a memory a reference voltage value and a first value corresponding to the sensed moisture level; comparing the stored values, to determine a completion of the drying procedure; obtaining a second value corresponding to the sensed moisture level by driving the heater for a second predetermined time after the completion of the drying procedure; and compensating for an error in the sensed moisture level by resetting the reference voltage value according to a comparison of the first and second values.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiment of the present invention, examples of which are illustrated in the accompanying drawings. Throughout the drawings, like elements are indicated using the same or similar reference designations where possible.

Figure 1:
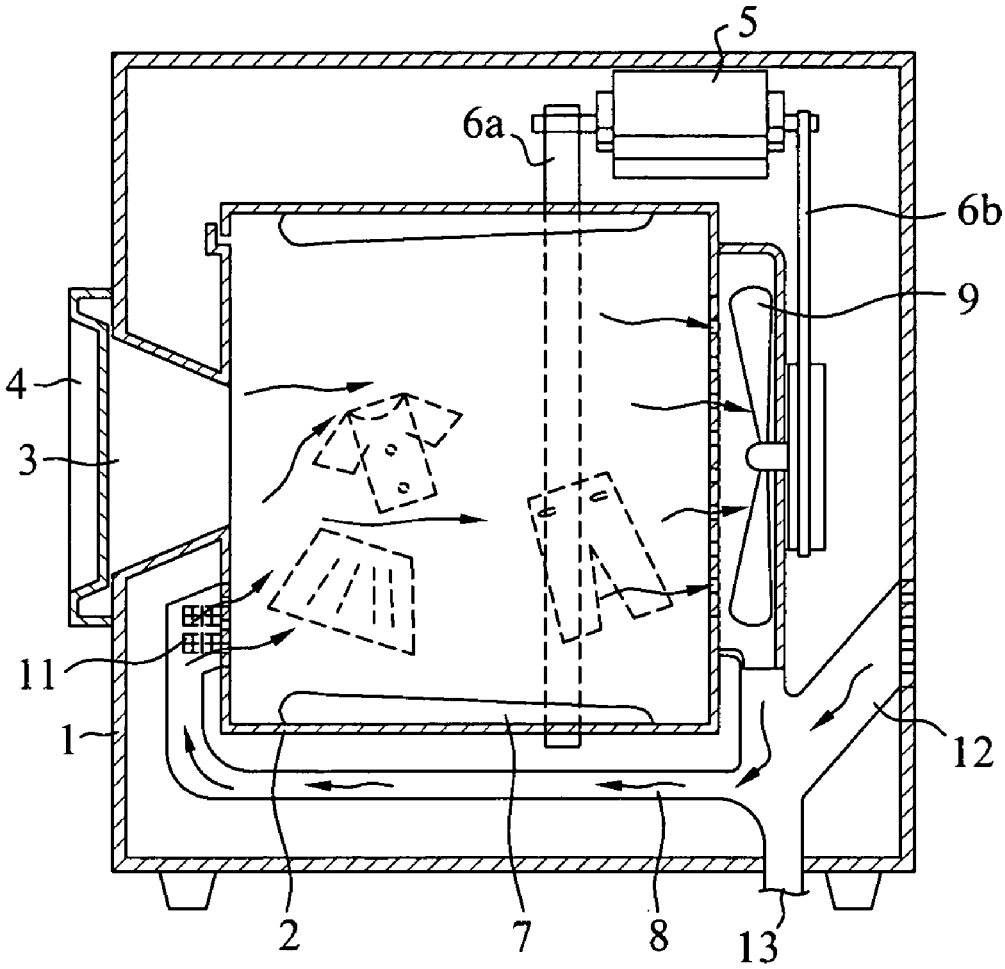
FIG. 1 Related Art
FIG. 1 is a cross-sectional view of a general laundry drier.
Figure 2:
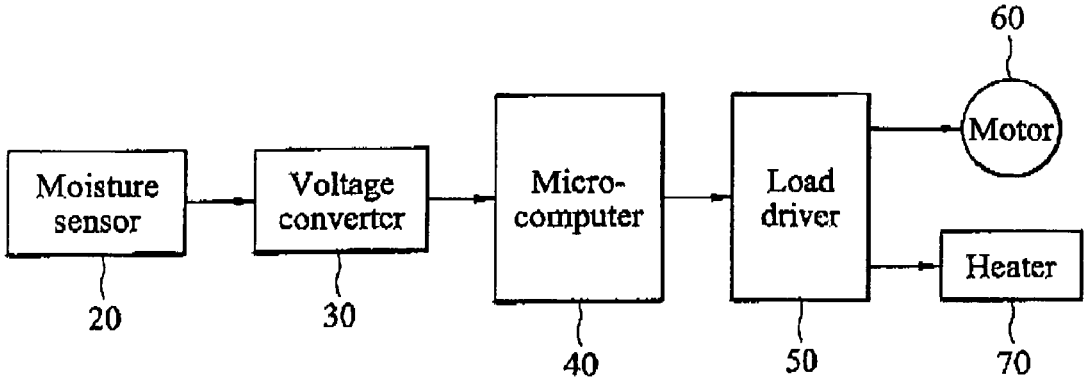
FIG. 2 Related Art
FIG. 2 is a block diagram of a control system of a laundry drier according to a related art.
Figure 3:
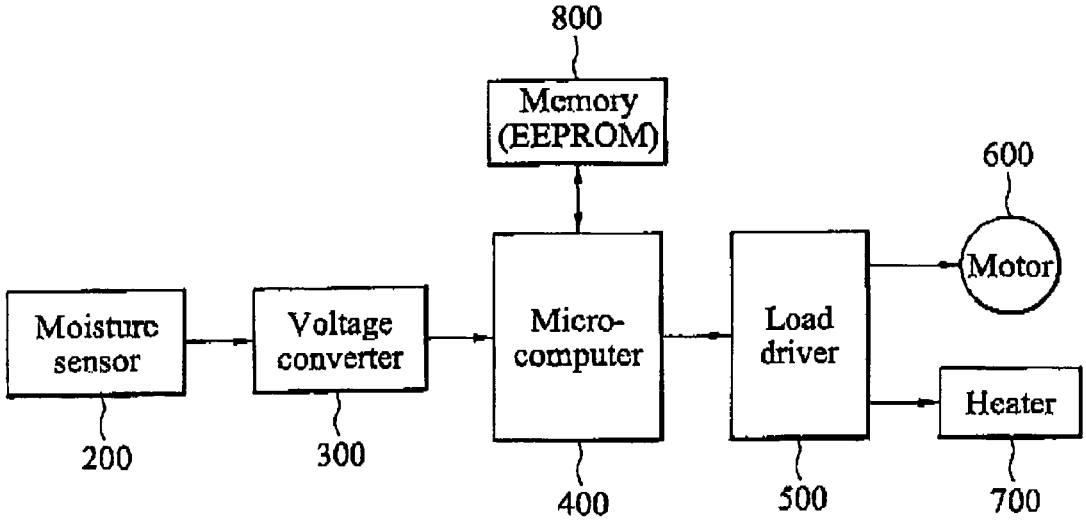
FIG. 3 is a block diagram of a control system of a laundry drier according to the present invention.

Referring to FIG. 3, a laundry drier according to the present invention is comprised of a moisture sensor 200, installed with respect to the interior of a rotatable drum as described with respect to the related art, for sensing (measuring) the water content of laundry in the drum to determine the drying status of the laundry over the course of a drying procedure and outputting a value indicative of the sensed water content; a voltage converter 300 for converting the sensed water content value to a voltage and outputting a corresponding voltage signal; an EE PROM memory 800 for storing a reference voltage value and voltage value according to the sensed water content upon completion of a drying procedure; a microcomputer 400 for outputting a control signal to control a drying pattern based on the voltage signal output of the voltage converter; and a load driver 500 for respectively driving a motor 600 and a heater 700 according to the control signal output from the microcomputer. At the end of a drying procedure, the microcomputer 400 compares stored voltage value with a predetermined value, to determine the presence of a contamination on and around the electrodes of the moisture sensor 200 and replace the stored value accordingly.

Figure 5:
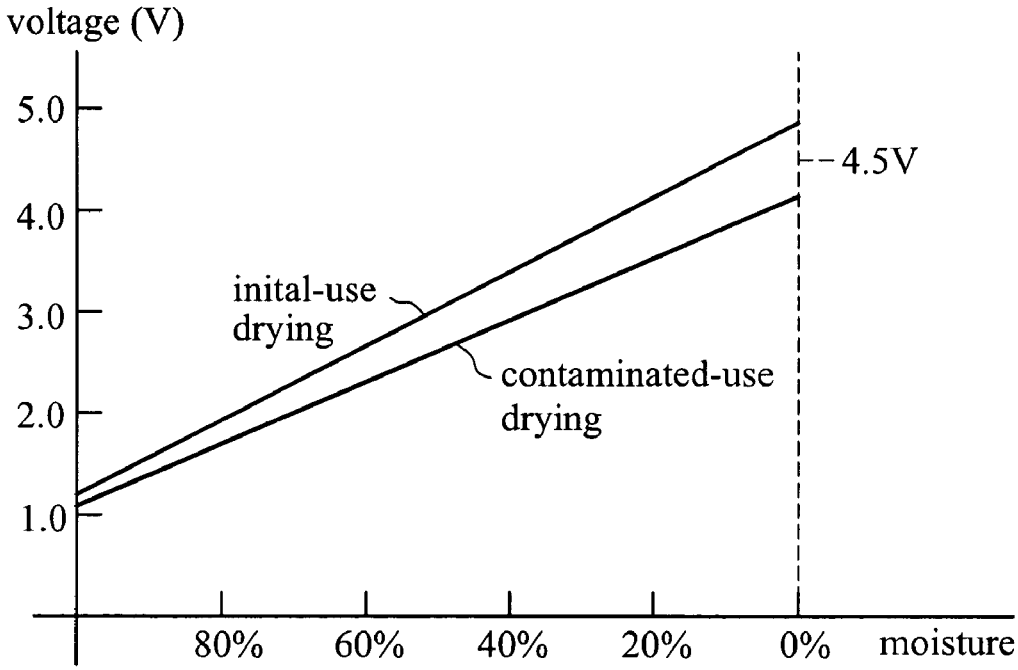
FIG. 5 is a flowchart of a method of compensating the sensed moisture of laundry in a laundry drier according to the present invention.

In the laundry drier according to the present invention, once a drying procedure is executed and the drum holding laundry is rotated, the laundry having a level of water content is brought into contact with the moisture sensor 200 and, in conjunction with the voltage converter 300, thereby generates a voltage output corresponding to the contact. The voltage output can be correlated with the moisture (sensed water content). Examples of such correlation are shown in FIG. 5. The moisture sensor 200 senses the moisture of the laundry to control a drying pattern. If contamination is present on or around the electrodes of the moisture sensor 200, there is an increased voltage drop across the electrodes for a given degree of sensed moisture. Therefore, a voltage value obtained at the completion of a drying procedure, i.e., after the potential accumulation of contamination on and around the electrodes of the moisture sensor 200, differs from a predetermined value corresponding to complete drying, and the accuracy of any moisture-sensing is affected accordingly.

Figure 4:
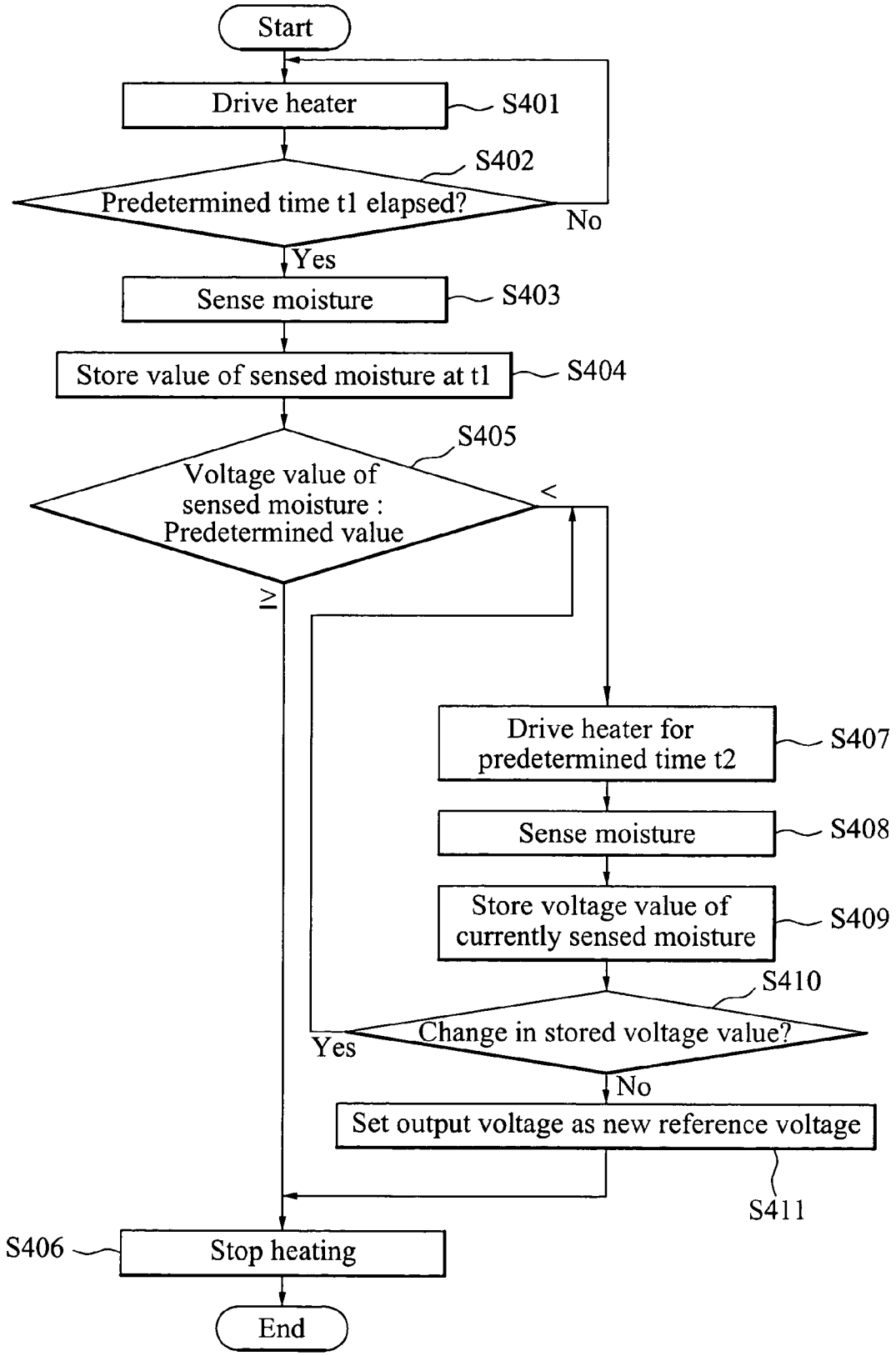
FIG. 4 is a graph showing sample plots of voltage versus sensed moisture in a laundry drier according to the present invention.

Referring to FIG. 4, illustrating a method of compensating for an error in sensing the water content of laundry in a laundry drier according to the present invention, upon execution of a dry procedure, the heater is driven in a step S401 for a predetermined time (t1) according to a step S402. While the heater is thus driven, a level of moisture is sensed in a step S403, which is converted into a voltage, and a value corresponding to the sensed moisture represented as a voltage value is stored in the memory 800 in a step S404. As drying proceeds, the voltage value increases. The stored voltage value is compared to a predetermined value, for example, 4.5V, in a step S405.

If the stored voltage value reaches or exceeds the predetermined value, it is determined that the drying procedure is completed and heating is stopped in a step S406. On the other hand, if after the predetermined time the stored voltage value is still less than the predetermined value, it is determined that the drying procedure may be incomplete or the moisture sensor 200 may be exhibiting signs of electrode contamination.

Accordingly, in steps S407, S408, and S409, a new voltage value corresponding to a subsequent (t2) sensing of moisture is obtained (i.e., stored in memory) for further comparison in a step S410. If the stored voltage value of the currently sensed moisture remains unchanged, it is determined that drying is complete and a new reference voltage is established in a step S411, but if a change is detected, it is determined that further drying is necessary. Here, the value of t2 may be gradually reduced so that the moment of drying completion can be detected. Hence, the laundry drier and control method thereof according to the present invention maintains an accurate reference voltage at the completion of the drying procedure by determining whether there is a difference between the sequentially stored voltage values.

That is, if after a predetermined time, the output voltage corresponding to the sensed moisture is at least as high as a known reference voltage, it can be assumed that the drying procedure has been normally performed, i.e., without sensor contamination, so that heating may be stopped. If the output voltage fails to reach the known reference voltage level, it is determined that sensor contamination has occurred, and the currently output voltage is stored in the memory 800 as the known reference for further drying procedures.

By adopting the laundry drier and control method thereof according to the present invention, the presence and degree of the contamination is detected by comparing the initial reference voltage, indicating the anticipated completion of a drying procedure, to the sensed voltage upon completion of each subsequent drying procedure. If a difference is detected, a new reference voltage is established. Accordingly, accurate moisture-sensing is enabled to prevent an improper heater operation, i.e., unnecessarily excessive heater operation. Thus, the present invention enables accurate moisture readings over the life of a laundry drier, by continuously compensating for an error caused by contaminated sensor electrodes.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A laundry dryer comprising:

a heater for performing a drying procedure on laundry;

a moisture sensor for sensing a level of moisture present in the laundry during the drying procedure and outputting a voltage signal;

memory configured to store a reference voltage value and a plurality of voltage values based on the sensed moisture level; and a microcomputer for controlling said heater based on the voltage signal output from said moisture sensor and for resetting the stored reference voltage value based on a comparison of two successively stored voltage values among the plurality of voltage values stored in said memory.

2. The laundry dryer as claimed in claim 1, wherein said memory is an EEPROM.

3. The laundry dryer as claimed in claim 1, wherein the moisture sensor is an electrode-type sensor and wherein the voltage signal is generated by the laundry being accommodated in a rotating drum to be brought into contact with said moisture sensor during the drying procedure.

4. A laundry dryer control method comprising steps of:

(a) driving a heater for a first predetermined time during a drying procedure performed on laundry;

(b) sensing a first level of moisture present in the laundry after the first predetermined time has elapsed;

(c) storing in memory a first value indicative of the sensed first moisture level;

(d) comparing the stored first value to a reference value to determine a completion of the drying procedure;

(e) driving, if said comparing step determines that the drying procedure is not completed, the heater for a second predetermined time;

(f) sensing a second level of moisture present in the laundry after the second predetermined time has elapsed;

(g) storing in the memory a second value indicative of the sensed second moisture level;

(h) determining whether sensor contamination is present by comparing the stored first and second values to obtain a contamination error; and (i) based on the contamination error to compensate for the sensor contamination.

5. The method as claimed in claim 4, further comprising a step of stopping said driving of the heater if the completion of the drying procedure is determined.

6. The method as claimed in claim 5, wherein the completion of the drying procedure is determined if, in said comparing step, the stored first value is not less than the reference value.

7. The method as claimed in claim 4, wherein said resetting step is performed if the stored second value differs from the stored first value.

8. The method as claimed in claim 4, wherein each of the first value and the second value are indicative of successive voltages output from a moisture sensor and wherein the reference value corresponds to a predetermined voltage output from the moisture sensor, the predetermined voltage corresponding to completion of a normal drying procedure.

9. The method as claimed in claim 4, wherein the drying procedure continues when, in said comparing step, the stored first value is less than the reference value.

10. The method as claimed in claim 9, wherein the drying procedure continues until there is no difference between the stored first value and the stored second value.

11. The method as claimed in claim 10, wherein the drying procedure is continued by repeating said steps (e) through (i) and wherein the second predetermined time is shortened for each repetition.

12. A laundry dryer comprising:

a moisture sensor for sensing a moisture level present in laundry during a drying procedure and generating a voltage signal according to the sensed moisture level;

memory configured to store a first voltage value indicative of a reference moisture level and a second voltage value based on the sensed moisture level; and a microcomputer for controlling the drying procedure based on the first stored voltage value and the second stored voltage value output from said moisture sensor, wherein the microcomputer is configured to compare the first stored voltage value with the second stored voltage value and configured to change a value indicative of the reference moisture level based on the comparison between the first stored voltage value with the second stored voltage value.

13. The laundry dryer as claimed in claim 12, further comprising a heater for drying the laundry according to the drying procedure.

14. The laundry dryer as claimed in claim 12, wherein said memory is an EEPROM.

15. The laundry dryer as claimed in claim 12, wherein the moisture sensor is an electrode-type sensor and wherein the voltage signal is generated when the laundry in a rotating drum contacts said moisture sensor during the drying procedure.

* * * * *